US005503521A

United States Patent [19]

Capon

[11] Patent Number: 5,503,521

[45] Date of Patent: Apr. 2, 1996

[54] CENTRIFUGAL PUMP

[75] Inventor: Reginald D. Capon, Kenosha, Wis.

[73] Assignee: Tetra Laval Holdings & Finance S.A., Pully, Switzerland

[21] Appl. No.: 275,237

[22] Filed: Jul. 14, 1994

[51] Int. Cl.[6] ..... F04D 7/04; F04D 29/22

[52] U.S. Cl. ..... 415/121.1; 415/206; 416/244 R; 416/245 R

[58] Field of Search ..... 415/121.1, 206; 416/185, 244 R, 245 R

[56] References Cited

U.S. PATENT DOCUMENTS

| | | | |
|---|---|---|---|
| 2,427,656 | 9/1947 | Blom . | |
| 2,669,938 | 2/1954 | La Bour | 416/214 |
| 2,836,898 | 10/1954 | Karassik . | |
| 2,932,661 | 5/1960 | Ricketts . | |
| 3,171,357 | 3/1965 | Egger . | |
| 3,213,798 | 10/1965 | Carswwell . | |
| 3,477,475 | 6/1969 | Blum | 415/121.1 |
| 3,481,273 | 12/1969 | Werra | 415/206 |
| 3,560,106 | 2/1971 | Sahlstrom | 415/206 |
| 3,632,220 | 1/1972 | Lansinger et al. | 415/112 |
| 3,639,073 | 2/1972 | Beck, Jr. et al. . | |
| 3,801,226 | 4/1974 | Bevan et al. . | |
| 4,402,648 | 9/1983 | Kretschmer | 415/206 |
| 4,538,959 | 9/1985 | Cantor et al. . | |
| 4,842,479 | 6/1989 | Dorsch | 415/206 |
| 5,030,062 | 7/1991 | Sutton . | |
| 5,245,726 | 9/1993 | Rote et al. | 415/121.1 |
| 5,256,032 | 10/1993 | Dorsch | 415/121.1 |
| 5,413,460 | 5/1995 | Wilson et al. | 415/206 |

*Primary Examiner*—Edward K. Look
*Assistant Examiner*—Michael S. Lee
*Attorney, Agent, or Firm*—Ryan, Maki & Hohenfeldt

[57] ABSTRACT

A centrifugal pump assembly including a housing containing a pump impeller having an axis of rotation with an inlet opening for fluids generally aligned with the axis of rotation of the impeller and a discharge opening aligned with the periphery of the impeller. The impeller is attached to a drive shaft for rotation by means of a central hub which has at least one circumferentially extending surface having an edge projecting toward the inlet at a circumference radially spaced from the axis of rotation. The surface, which is progressively recessed away from the inlet toward the rotational axis, modifies fluid flow through the pump to reduce whirling motion in the inlet, thereby significantly improving efficiency of the pump. Preferably at least two of such surfaces of different diameters in stepped relationship are provided, each of the surfaces being raised toward the inlet at a circumference spaced from the axis of rotation and progressively being recessed away from the inlet in a direction advancing toward the axis of rotation. Both such surfaces may be provided either on the hub or on the surface of the impeller or one such surface can be located on the hub and at least one additional such surface located on the surface of the impeller blade facing the inlet.

9 Claims, 3 Drawing Sheets

CENTRIFUGAL PUMP

FIELD OF THE INVENTION

This invention relates to centrifugal pumps, particularly of the type utilized for pumping liquids in sanitary food processing equipment. Specifically, the invention relates to an improved configuration for such pumps which improves the efficiency thereof.

BACKGROUND OF THE INVENTION

Centrifugal pumps have been used for many years for pumping of liquids such as foods. See, for example, U.S. Pat. Nos. 3,481,273 and 4,538,959. A problem that has occurred with such pumps is the fact that the pump impeller will cause rotation of the liquid flowing through the inlet conduit. This action, sometimes referred to as "pre-whirl", causes a loss of efficiency in the pump. It also requires that a relatively high net positive pressure must be maintained in the inlet in order to cause pumping to continue. Previous attempts to address this problem have included the use of an inlet having a relatively narrow neck adjacent the impeller as seen, for example, in FIG. 1 of the above-noted '959 patent. While such previous modifications have improved the problem to a degree, it has still persisted, and, thus, the need has continued to exist for improved pump designs that maintain high pumping efficiency at low positive inlet pressures.

SUMMARY OF THE INVENTION

An important object of the present invention is to provide a rotary centrifugal pump design that minimizes or eliminates pre-whirl in the inlet conduit. An important aspect of the invention is to reduce or eliminate such spiraling motion by breaking up of the traditional flow patterns entering such pumps.

A further aspect of the invention is to provide a pump in which the impeller and/or hub is provided with one or more stepped surfaces that slope away from the inlet progressively toward the axis of rotation of the impeller. Preferably, two or more such surfaces are provided.

In accordance with a preferred embodiment, the hub for attachment of the impeller to the drive motor also has a conically-shaped central surface that extends toward the inlet. In accordance with a related aspect of the invention, the throat of the inlet is constructed without any necking.

Briefly, the invention provides a centrifugal pump assembly including a housing containing a pump impeller having an axis of rotation with an inlet opening for fluids generally aligned with the axis of rotation of the impeller and a discharge opening aligned with the periphery of the impeller. The impeller is attached to a drive shaft for rotation by means of a central hub. The hub and/or the surface of the impeller facing the inlet have at least one circumferentially extending surface having an edge projecting toward the inlet at a circumference radially spaced from the axis of rotation. This surface, which is progressively recessed away from the inlet toward the rotational axis, modifies fluid flow through the pump to reduce whirling motion in the inlet, thereby significantly improving efficiency of the pump. Preferably at least two of such surfaces of different diameters in stepped relationship are provided, each of the surfaces being raised toward the inlet at a circumference spaced from the axis of rotation and progressively being recessed away from the inlet in a direction advancing toward the axis of rotation. Both such surfaces may be provided either on the hub or on the surface of the impeller or one such surface can be located on the hub and at least one additional such surface located on the surface of the impeller blade facing the inlet.

Preferably, the hub is provided with a conical surface whose apex extends toward the inlet. Also, preferably, the inlet opening is not necked down, but instead provides a straight through flow conduit.

Further objects and advantages of the invention will be apparent from the following detailed description and accompanying drawings.

DETAILED DESCRIPTION OF THE DRAWINGS

Figure 2:
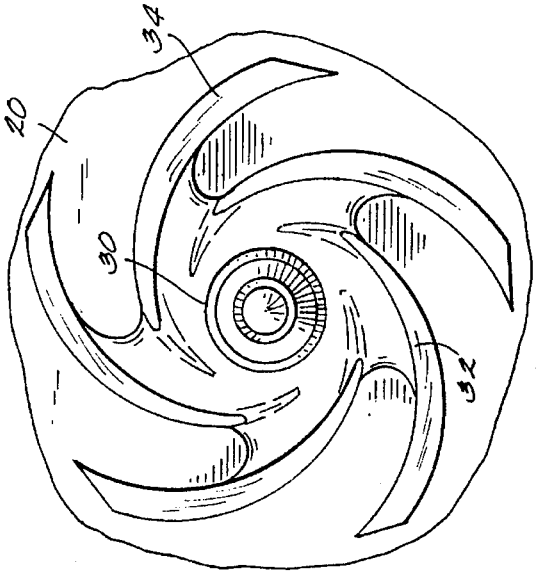
FIG. 2 is a view of an impeller and hub of the pump of FIG. 1 taken along line 2—2 of FIG. 1.
Figure 1:
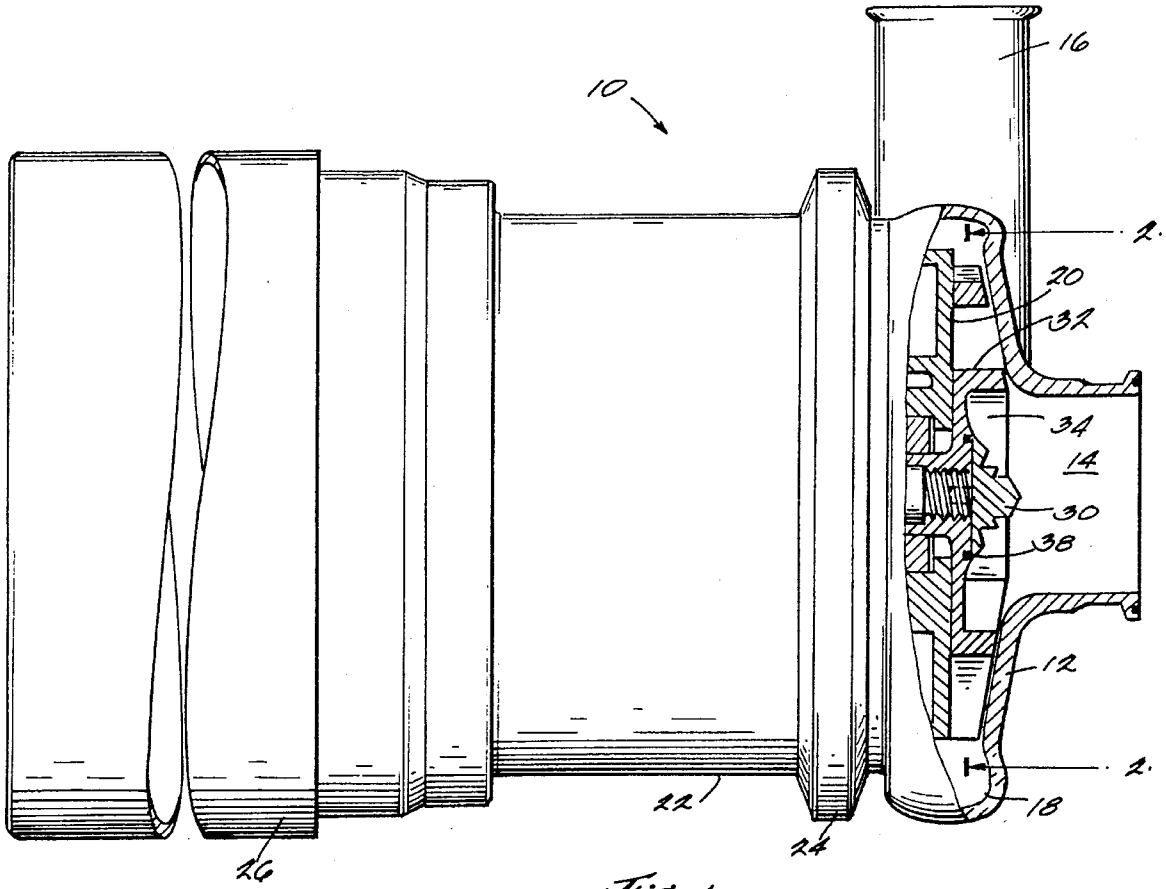
FIG. 1 is a side view of a pump of the present invention with parts broken away and in cross-section.

Referring more particularly to the drawings, there is illustrated a centrifugal pump 10 of the general type utilized in sanitary food processing equipment. The pump includes a housing 12 having a central inlet 14 in a discharge outlet 16 formed in the perimeter 18 of the housing 12. Housing 12 is closed by means of a back plate 20 and is secured to an adapter ring 22 by means of a clamping ring 24. The adapter ring is affixed to a motor 26.

Motor 26 drives a shaft 28 to which a hub 30 is threadedly connected. An impeller 32 usually having vortex-shaped blades 34 is attached to the shaft 38 by means of threaded shaft 36 of hub 30. O-rings 38 or similar seal is provided to prevent leakage of fluids into the area of shaft 28.

Figure 4:
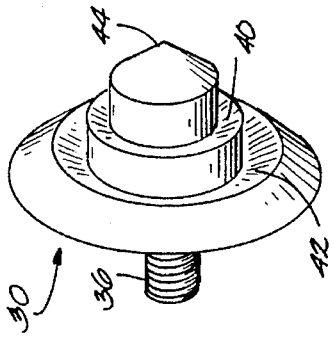
FIG. 4 is a perspective view a hub component of the pump of FIG. 3.
Figure 3:
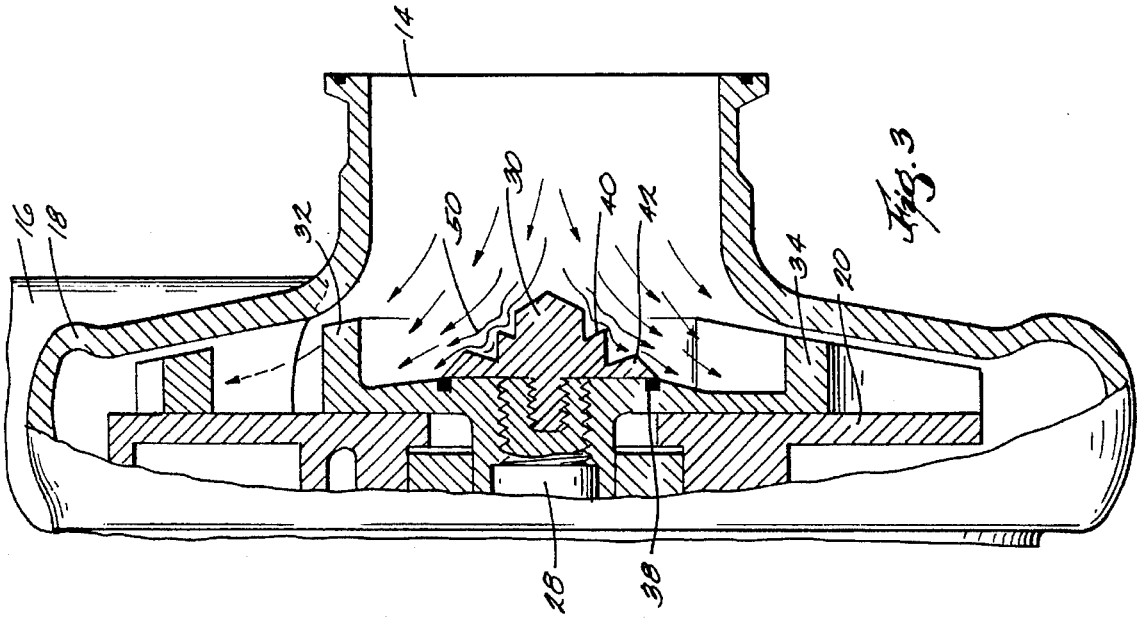
FIG. 3 is an enlargement of the pumping components of the pump of FIG. 1 shown enlarged and with fluid flow indicated therethrough.

Referring to FIGS. 3 and 4, hub 30 is provided on its upper surfaces with one or more surfaces 40 and 42 that extend at their perimeters toward the inlet or forward end 44 of hub 30. It will be noted that surfaces 40 and 42 slope radially inwardly toward the rotational axis of hub 30, i.e. the surfaces are progressively recessed away from the inlet, moving from the perimeter of the hub toward its rotational axis.

As seen in FIG. 3, while the exact nature of fluid flow changes within the pump are not fully understood, it is believed that eddy currents 50 are formed which effectively direct the flow away from the hub area of the pump and cause the fluids to flow more efficiently toward outlet 16. The stepped surfaces, unexpectedly, have been effective in substantially eliminating or at least greatly reducing the amount of pre-whirl or rotational flow that occurs within the input conduit leading to the inlet opening 14 of pump 10.

Figure 6:
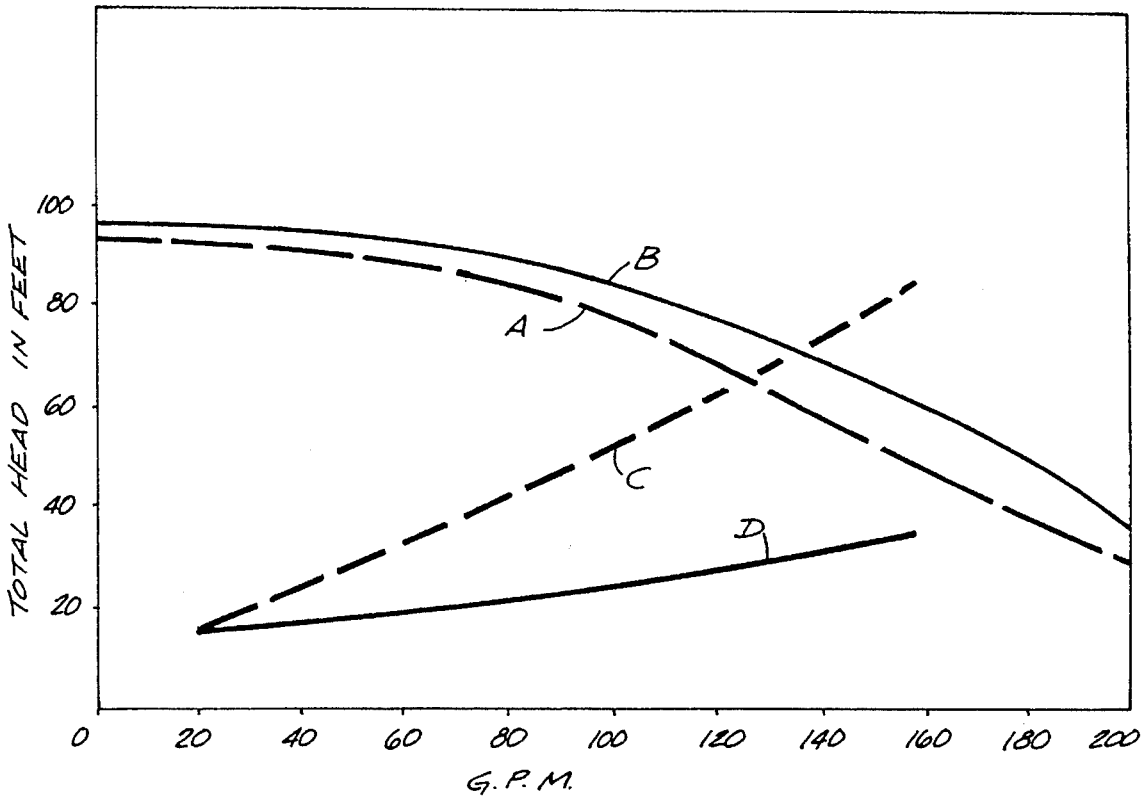
FIG. 6 is a graph comparing the total head and flow rate of a prior art impeller to the impeller of the present invention.

A dramatic decrease in the pressure head required to be maintained in the inlet is illustrated in FIG. 6. In FIG. 6 there is shown a graphical plot of gallons per minute pumped vs. the total head in feet. Curves A and B illustrate the total head in feet produced by a pump of the prior art compared to that of the present invention. Curve A represents the total head versus gallons per minute pumped using a standard impeller/hub combination of the prior art. Curve B shows the amount of increase of total head produced by substituting a hub of the present invention, at various pumping rates.

Curves C and D are plots of the minimum head pressure necessary to be applied to the inlet to achieve pumping at various rates. It will be noted that, particularly in the case of Curve C, a substantial increase in said pressure is required as the pumping rate is increased. The pressure on the inlet, if not maintained at or above the levels shown on the curves, results in severe reduction of pumping output, which can lead to a complete loss of flow. In this regard, curve C represents the input pressure versus gallon per minute required with prior art impellers and curve D illustrates the dramatic improvement in that respect achieved by the present invention. It is believed that the spiralling motion which causes pre-whirl in the intake is broken up by upsetting of the flow patterns that exist in the pump chamber, by means of the sloping surfaces on the hub.

Figure 5:
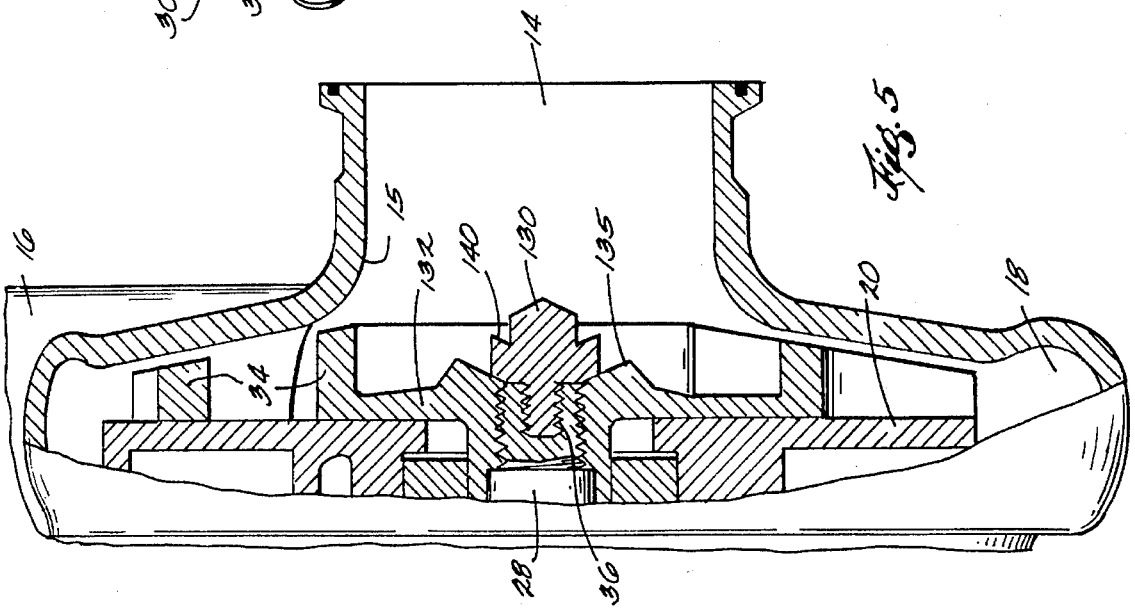
FIG. 5 is a fragmentary view of an alternate embodiment of the invention with parts broken away and in cross-section.

In the alternative embodiment shown in FIG. 5, hub 130 is of a smaller diameter than in the case of the earlier described embodiment. Hub 130 is provided with a single inwardly sloping surface 140. An additional sloping surface 135 is provided on the surface of the impeller blade 132. It will be apparent that the resulting overall configuration, however, is similar to that of the earlier described embodiment.

While preferred embodiments of the invention have been shown for purposes of illustration, it will be apparent for those skilled in the art that various further modifications can be made without departing from the spirit of the invention. The invention is, thus, intended to encompass the subject matter of the appended claims, together with equivalent structures thereto.

What is claimed is:

1. A centrifugal pump assembly comprising:

a housing containing a pump impeller having an axis of rotation, said housing having an inlet opening for fluids generally aligned with the axis of rotation of said impeller, said housing being provided with a discharge opening aligned with the periphery of said impeller, said inlet being aligned with the axis of rotation of said impeller, said impeller being attached to a drive shaft for rotation, at least one circumferentially extending surface positioned on the inlet side of said impeller having an edge projecting toward said inlet at a circumference radially spaced from said axis of rotation, said surface being progressively recessed away from said inlet toward said rotational axis.

2. A pump assembly according to claim 1 wherein said surface is located on a hub used to secure said impeller to a drive shaft.

3. A pump assembly according to claim 2 wherein said hub has two stepped surfaces of different diameters, each of said surfaces being raised toward said inlet at a circumference spaced from said axis of rotation and progressively being recessed away from said inlet in a direction advancing toward said axis of rotation.

4. A pump assembly according to claim 1 wherein at least one such surface is located on said hub and at least one additional such surface is located on the surface of the impeller blade web facing said inlet.

5. A pump assembly according to claim 1 wherein said inlet opening has an open configuration free of restrictions.

6. A pump assembly according to claim 2 wherein said hub has a conical surface at its axis of rotation, the apex of said conical surface projecting toward said inlet.

7. A centrifugal pump assembly comprising:

a housing containing a pump impeller having an axis of rotation, said housing having an inlet opening for fluids generally aligned with the axis of rotation of said impeller, said housing being provided with a discharge opening aligned with the periphery of said impeller, said inlet being aligned with the axis of rotation of said impeller, said impeller being attached to a drive shaft for rotation by means of a central hub, said hub having at least one circumferentially extending surface having an edge projecting toward said inlet at a circumference radially spaced from said axis of rotation, said surface being progressively recessed away from said inlet toward said rotational axis.

8. A pump assembly according to claim 7 wherein said hub has a conical surface at its axis of rotation, the apex of said conical surface projecting toward said inlet.

9. A pump assembly according to claim 7 wherein said inlet opening has an open configuration free of restrictions.

* * * * *